US012796801B2

(12) United States Patent
Hu

(10) Patent No.: US 12,796,801 B2
(45) Date of Patent: Nov. 17, 2026

(54) OPENING CLAMPING DEVICE FOR MOBILE PHONE WATERPROOF BAG

(71) Applicant: Xiaopeng Hu, Dongguan (CN)

(72) Inventor: Xiaopeng Hu, Dongguan (CN)

( * ) Notice: Subject to any disclaimer, the term of this patent is extended or adjusted under 35 U.S.C. 154(b) by 112 days.

(21) Appl. No.: 19/010,746

(22) Filed: Jan. 6, 2025

(65) Prior Publication Data

US 2026/0083237 A1 Mar. 26, 2026

(30) Foreign Application Priority Data

Sep. 26, 2024 (CN) ..... 202422348652.6

(51) Int. Cl.
*A45F 5/00* (2006.01)
*B65D 55/04* (2006.01)

(52) U.S. Cl.
CPC ..... *A45F 5/1516* (2025.01); *B65D 55/04* (2013.01)

(58) Field of Classification Search
CPC ..... A45C 3/10; A45C 11/002; A45C 11/22; A45C 13/008
See application file for complete search history.

(56) References Cited

U.S. PATENT DOCUMENTS

| | | | | |
|---|---|---|---|---|
| 1,752,464 | A * | 4/1930 | Specter | A45C 13/008 383/69 |
| 5,797,683 | A * | 8/1998 | Gunzi | A45C 13/008 383/68 |
| 11,950,670 | B2 * | 4/2024 | Yang | A45C 11/003 |
| 2022/0031035 | A1 * | 2/2022 | Yu | A45C 11/22 |
| 2023/0380560 | A1 * | 11/2023 | Naftali | A45F 3/20 |
| 2024/0306782 | A1 * | 9/2024 | Kong | A45C 11/22 |

FOREIGN PATENT DOCUMENTS

| | | | |
|---|---|---|---|
| CN | 209796273 U | | 12/2019 |
| CN | 210611313 U | * | 5/2020 |

* cited by examiner

*Primary Examiner* — Corey N Skurdal
(74) *Attorney, Agent, or Firm* — Birchwood IP

(57) ABSTRACT

An opening clamping device for a mobile phone waterproof bag is provided, which includes a first sealing member, a second sealing member, and a third sealing member. The second sealing member is provided between the first sealing member and the third sealing member. One side of the first sealing member is rotatably connected to the third sealing member, and the other side of the first sealing member is capable of being fastened to the second sealing member. The second sealing member is capable of being fastened to the third sealing member. The second sealing member and the third sealing member are configured to clamp a side of the mobile phone waterproof bag with an opening. When the first sealing member is fastened to the second sealing member, the side of the mobile phone waterproof bag with the opening is clamped and sealed.

9 Claims, 7 Drawing Sheets

OPENING CLAMPING DEVICE FOR MOBILE PHONE WATERPROOF BAG

CROSS-REFERENCE TO RELATED APPLICATIONS

This application claims priority to Chinese Patent Application No. 202422348652.6, filed on Sep. 26, 2024, which is hereby incorporated by reference in its entirety.

TECHNICAL FIELD

The present disclosure relates to the field of storage device technologies, and in particular, to an opening clamping device for a mobile phone waterproof bag.

BACKGROUND

With a widespread application of smartphones, the demand for smartphones has increased in underwater environments such as swimming and diving, and waterproof protection has become an important requirement for a user when using smartphones. Traditional waterproof bags for mobile phones are usually sealed using simple zippers or buckles. Although they can prevent moisture from entering to a certain extent, sealing effects of these ways are easily weakened in high-pressure water environments or prolonged immersion, which affects the protective performance of the mobile phone and may even cause damage to the mobile phone due to water seepage inside the waterproof bags. CN209796273U discloses a waterproof bag sealed with a clamp plate, but there is still a need to improve in the sealing design of this technology, especially in more complex use scenarios. In order to further improve the sealing and convenience of the waterproof bag, the structure of waterproof bag needs to be further optimized.

SUMMARY

The present disclosure proposes an opening clamping device for a mobile phone waterproof bag, which aims to solve a problem of poor sealing and inconvenient use of traditional waterproof bags.

To achieve the above objectives, a clamping device proposed by the present disclosure includes:

- a first sealing member, a second sealing member, and a third sealing member; where the second sealing member is provided between the first sealing member and the third sealing member;
- one side of the first sealing member is capable of being rotatably connected to the third sealing member, and the other side of the first sealing member is capable of being fastened to the second sealing member;
- the second sealing member is capable of being connected to the third sealing member; the second sealing member and the third sealing member are configured to clamp a side of the mobile phone waterproof bag with an opening; when the first sealing member is fastened to the second sealing member, the side of the mobile phone waterproof bag with the opening is clamped and sealed.

In some embodiments of the present disclosure, the second sealing member is provided with a buckle groove and an arc-shaped portion, where the arc-shaped portion is provided on one side of the buckle groove and extended towards the third sealing member;

- the third sealing member is provided with an installation groove and a curved portion; and the curved portion is provided on one side of the installation groove and bending extended towards the second sealing member;
- when the second sealing member and the third sealing member are fastened, the arc-shaped portion is extended into the installation groove and the curved portion is extended into the buckle groove.

In some embodiments of the present disclosure, there are a plurality of buckle grooves, and the plurality of buckle grooves are symmetrically arranged on two sides of a central axis the second sealing member.

In some embodiments of the present disclosure, an area of the first sealing member is larger than an area of each of the plurality of buckle grooves, and when the first sealing member is fastened with the second sealing member, the first sealing member covers the buckle grooves.

In some embodiments of the present disclosure, the clamping device further includes a connection column, where the first sealing member and the third sealing member are arranged side by side on the connection column, two ends of the third sealing member are sleeved on two ends of the connection column; the first sealing member that is at an inner side of the third sealing member is sleeved on the connection column;

- the second sealing member has a first half ring, and the first half ring is provided at a middle of the second sealing member;
- the third sealing member has a second half ring; the first half ring and the second half ring are closed to each other at a middle of the connection column; the connection column is provided between the first half ring and the second half ring.

In some embodiments of the present disclosure, a notch is provided at a middle of the first half ring, and the notch is configured to separate the second sealing member and the third sealing member.

In some embodiments of the present disclosure, the first sealing member is provided with a compression protrusion, and the second sealing member is provided with a compression groove, the compression groove is provided at the middle of the second sealing member, and the compression protrusion is provided on the compression groove.

In some embodiments of the present disclosure, four sides of the compression protrusion are protruded in a direction away from the second sealing member, thereby forming a buckle position.

In some embodiments of the present disclosure, a surface the second sealing member facing the first sealing member is provided with an anti-slip area, and the anti-slip area is provided with a protrusion.

In some embodiments of the present disclosure, the clamping device further includes a waterproof bag,

- where a side of the waterproof bag with the opening is provided between the second sealing member and the third sealing member; the waterproof bag has a cavity configured to store an item; and/or,
- the clamping device further includes a suspension rope connected to the third sealing member.

The technical solution of the present disclosure achieves sealing of the opening of the mobile phone waterproof bag by using the first sealing member, the second sealing member, and the third sealing member. Specifically, the first sealing member can be connected to the second sealing member, and the second sealing member and the third sealing member can be connected in a detachable manner. Through this connection way, when applied, the opening of the mobile phone waterproof bag is first placed between the second sealing member and the third sealing member, and the second sealing member and the third sealing member are closed to position and clamp the opening of the mobile phone waterproof bag. At the same time, the mobile phone waterproof bag also applies outward separation force to the second sealing member and the third sealing member, and then the first sealing member is fastened to the second sealing member, so that the second sealing member and the third sealing member are pressed against each other, thereby achieving sealing of the opening of the mobile phone waterproof bag, thereby increasing the sealing of the opening of the phone waterproof bag.

Furthermore, the second sealing member and the third sealing member can be connected in a detachable manner. One side of the first sealing member is rotatably connected to the third sealing member. When installing or taking out the mobile phone waterproof bag, the first sealing member is rotated to open and close. A pressure exerted by the first sealing member on the second sealing member and the third sealing member disappears, the second sealing member and the third sealing member are stretched open by the mobile phone waterproof bag, which enables convenient disassembly of the mobile phone waterproof bag.

Overall, the first sealing member, second sealing member, and the third sealing member are connected in a cooperation manner. Compared to the traditional two-piece connection way, the first sealing member strengthens a connection between the second sealing member and the third sealing member, and the opening clamping device for the mobile phone waterproof bag has good overall integrity.

BRIEF DESCRIPTION OF DRAWINGS

In order to provide a clearer explanation of the embodiments of the present disclosure or the technical solutions in the prior art, a brief introduction will be given to the accompanying drawings required for a description of the embodiments or the prior art. It is obvious that the accompanying drawings described below are only some embodiments of the present disclosure. For those skilled in the art, other drawings can be obtained based on the structures shown in these drawings without creative work.

NUMERAL REFERENCE

100 clamping device; 30 third sealing member; 10 first sealing member; 301 installation groove; 101 compression protrusion; 302 curved portion; 1011 buckle position; 310 second half ring; 20 second sealing member; 50 connection column; 201 buckle groove; 60 waterproof bag; 202 arc-shaped portion; 70 suspension rope; 203 notch; 204 compression groove; 205 anti-slip area; 210 first half ring.

The implementation, functional characteristics, and advantages of the purpose of the present disclosure will be further explained in combination with the embodiments and with reference to the accompanying drawings.

DESCRIPTION OF EMBODIMENTS

The following will provide a clear and complete description of the technical solution in the embodiments of the present disclosure, based on the accompanying drawings. Obviously, the described embodiments are only a part of the embodiments of the present disclosure, not all of them. Based on the embodiments in the present disclosure, all other embodiments obtained by those skilled in the art without creative work are within the protection scope of the present disclosure.

Figure 1:
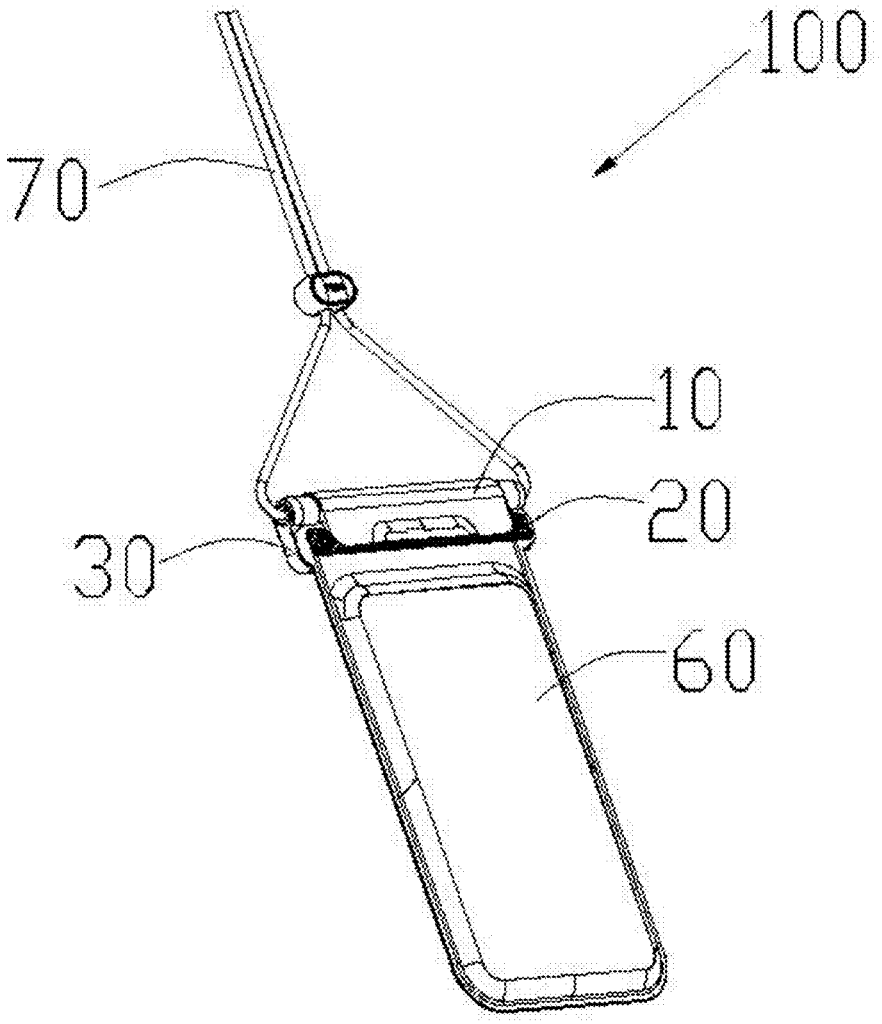
FIG. 1 is a schematic structural diagram of a clamping device of the present disclosure.
Figure 2:
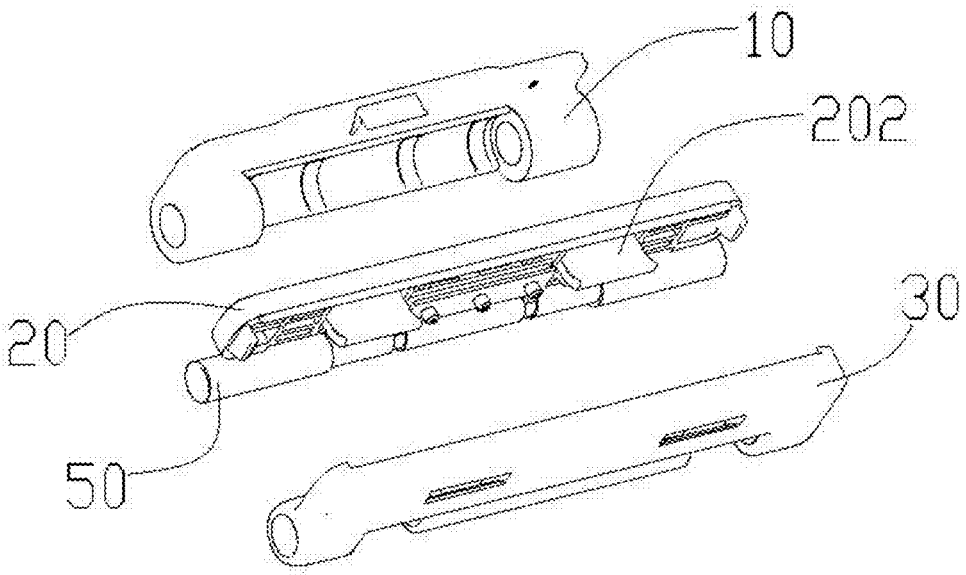
FIG. 2 is an exploded view of a first sealing member, a second sealing member, and a third sealing member when connected in the present disclosure.

Referring to FIGS. 1 and 2, the present disclosure proposes an opening clamping device for a mobile phone waterproof bag 100, which includes a first sealing member 10, a second sealing member 20, and a third sealing member 30. The second sealing member 20 is located between the first sealing member 10 and the third sealing member 30; one side of the first sealing member 10 is rotatably connected to the third sealing member 30, such as a nut fit or sleeve structure. The other side of the first sealing member 10 can be fastened to the second sealing member 20, and the second sealing member 20 can be connected to the third sealing member 30. The second sealing member 20 and the third sealing member 30 are configured to clamp an opening of the mobile phone waterproof bag, when the first sealing member 10 is fastened to the second sealing member, the bag is pressed tightly.

In an implementation mode, the first sealing member 10 can be connected to the second sealing member 20 in a detachable manner, and the second sealing member 20 is connected to the third sealing member 30 in a detachable manner. Through this connection way, when applied, a side of the mobile phone waterproof bag with the opening is first placed between the second sealing member 20 and the third sealing member 30, and the second sealing member 20 and the third sealing member 30 are closed to position and clamp the side of the mobile phone waterproof bag with the opening. At the same time, the mobile phone waterproof bag also applies outward separation force to the second sealing member 20 and the third sealing member 30, and then the first sealing member 10 is fastened to the second sealing member 20, so that the second sealing member 20 and the third sealing member 30 are pressed against each other. Which achieves clamping and sealing the side of the mobile phone waterproof bag with the opening and increases the sealing performance of the opening of the mobile phone waterproof bag.

In an implementation mode, the second sealing member 20 and the third sealing member 30 can be connected in a detachable manner. One side of the first sealing member 10 is rotatably connected to the third sealing member 30. When installing or taking out the mobile phone waterproof bag, the first sealing member 10 is rotated to open and close, a pressure exerted by the first sealing member 10 on the mobile phone waterproof bag disappears. The second sealing member 20 and the third sealing member 30 are stretched open by the mobile phone waterproof bag, which enables convenient disassembly of the mobile phone waterproof bag.

Overall, the first sealing member 10, the second sealing member 20, and the third sealing member 30 are connected in a cooperation manner. Compared to the traditional two-piece connection way, the first sealing member 10 strengthens a connection between the second sealing member 20 and the third sealing member 30, rendering an overall sealing performance of the opening clamping device for a mobile phone waterproof bag 100 stronger.

In an implementation mode, there is no limit to the connection way of the first sealing member 10 and the second sealing member 20. For example, one or more cooperating ways such as buckle fasteners, snap fasteners, magnetic suction fasteners, etc. can be set to achieve a detachable connection of the first sealing member and the second sealing member.

Figure 3:
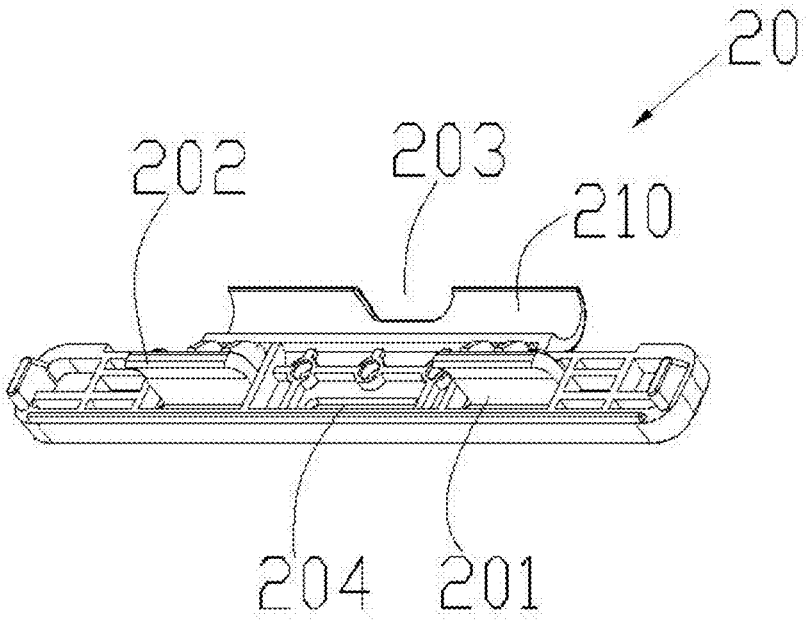
FIG. 3 is a schematic structural diagram of the second sealing member of the present disclosure.
Figure 4:
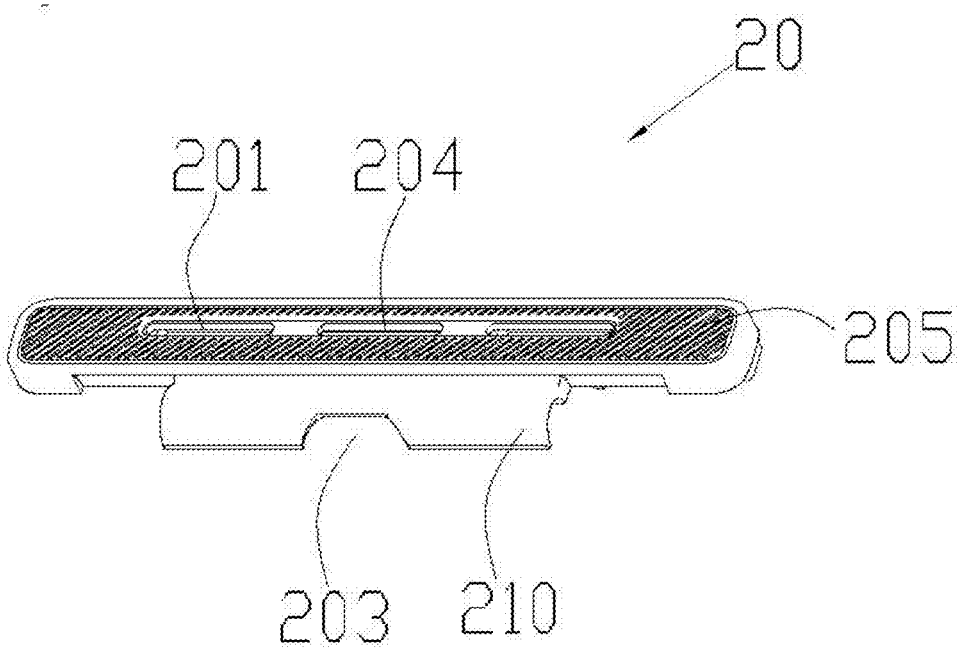
FIG. 4 is a schematic structural diagram of the second sealing member of the present disclosure from another perspective.
Figure 5:
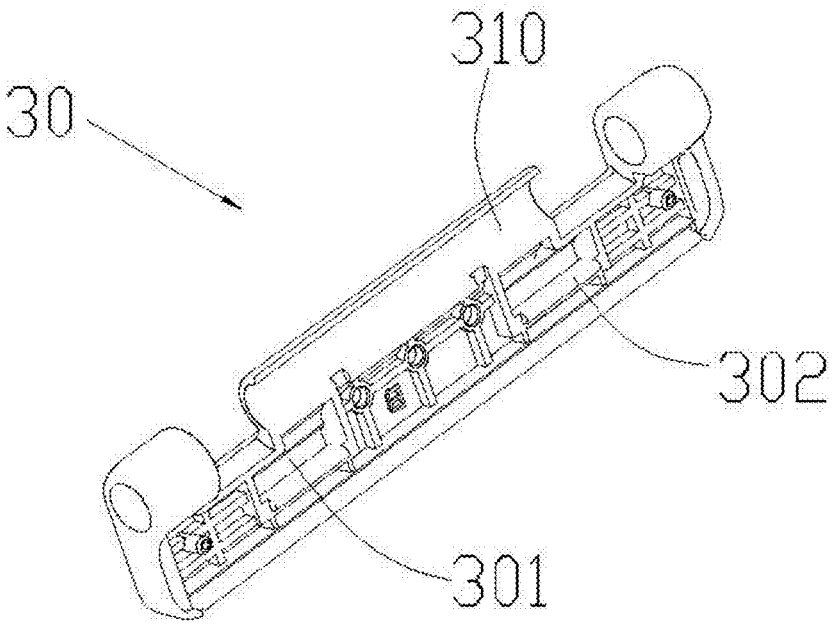
FIG. 5 is a schematic structural diagram of the third sealing member of the present disclosure.

In an implementation mode, referring to FIGS. 3 to 5, the second sealing member 20 is provided with a buckle groove 201 and an arc-shaped portion 202. The arc-shaped portion 202 is provided on one side of the buckle groove, 201 and is extended towards the third sealing member 30. The third sealing member 30 is provided with an installation groove 301 and a curved portion 302. The curved portion 302 is provided on one side of the installation groove 301 and is bending extended towards the second sealing member 20. When the second sealing member 20 and the third sealing member 30 are fastened, the arc-shaped portion 202 is attached to the curved portion 302, the arc-shaped portion 202 is extended into the installation groove 301, and the curved portion 302 is extended into the buckle groove 201. The second sealing member 20 is installed in the installation groove 301 of the third sealing member 30 through the arc-shaped portion 202. The third sealing member 30 is installed in the buckle groove 201 of the second sealing member 20 through the arc-shaped portion 202, thereby achieving a mutual connection between the second sealing member 20 and the third sealing member 30 and strengthening a fit degree of a connection between the two.

In this way, the arc-shaped portion 202 is attached to the curved portion 302, allowing the second sealing member 20 and the third sealing member 30 to be more tightly attached when connected, reducing gaps and effectively preventing water vapor from entering. The arc-shaped portion 202 and the curved portion 302 are attached more flexibly when separated, rendering it easier for a user to open, install and disassemble the waterproof storage bag.

In an implementation mode, the buckle groove 201 and the arc-shaped portion 202 are integrated, and one side edge of the buckle groove 201 is extended towards the third sealing member 30 to form the arc-shaped portion 202. Similarly, the installation groove 301 and the curved portion 302 are integrated, and one side edge of the installation groove 301 is bended and extended towards the second sealing member 20 to form the curved portion 302, rendering the integrity of the second sealing member 20 and the third sealing member 30 stronger and reducing a production cost.

In an implementation mode, there are a plurality of buckle grooves 201, and at least two buckle grooves 201 are symmetrically arranged on two sides of a central axis of the second sealing member 20 to increase a sealing performance and a balance of an overall structure of the clamping device 100.

Figure 6:
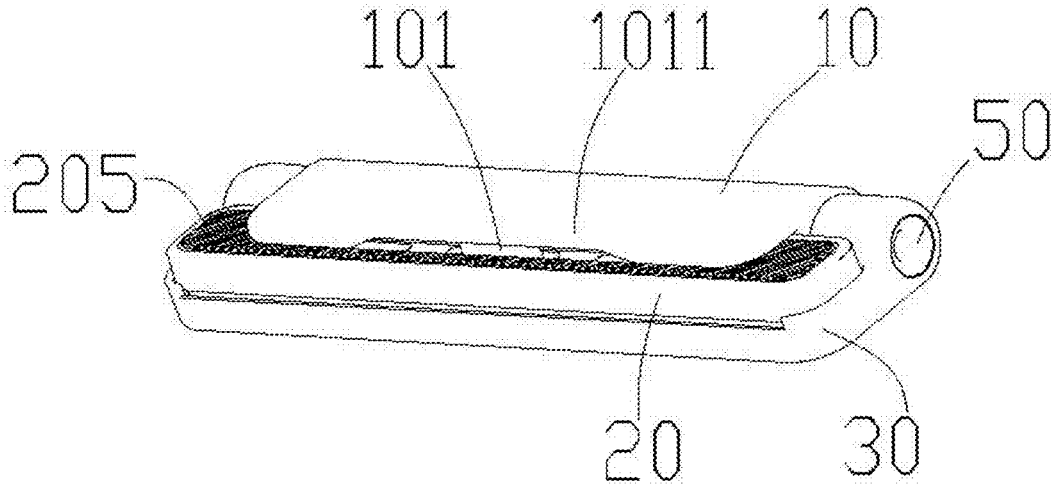
FIG. 6 is a schematic structural diagram the first sealing member, the second sealing member, and the third sealing member when connected in the present disclosure.

In an implementation mode, referring to FIG. 6, the first sealing member 10 is provided with a compression protrusion 101, and the second sealing member 20 is provided with a compression groove 204, the compression groove 204 is provided at a middle of the second sealing member 20. The compression protrusion 101 can be installed on the compression groove 204 in a detachable manner. In this way, the first sealing member 10 and the second sealing member 20 can be connected in a detachable manner. After the waterproof storage bag is installed on the second sealing member 20 and the third sealing member 30, it is convenient to press the waterproof storage bag tightly, thereby further enhancing a waterproof effect.

In an implementation mode, the compression groove 204 and the buckle groove 201 are evenly provided on the second sealing member 20 to ensure that the first sealing member 10 and the third sealing member 30 are connected and uniformly subjected by force.

In an implementation mode, four sides of the compression protrusion 101 are protruded in a direction away from the second sealing member 20, thereby forming a buckle position 1011, which facilitates the user to open and close the second sealing member 20 by rotating the first sealing member 10.

In an implementation mode, an area of the first sealing member 10 is larger than an area of each of the buckle grooves 201. When the first sealing member 10 is fastened with the second sealing member 20, the first sealing member 10 covers the buckle grooves 201, which can block water vapor and prevent it from directly entering the buckle grooves 201, thereby further reducing a possibility of water ingress into the waterproof storage bag.

In an implementation mode, a length of the buckle groove 201 is greater than or equal to 15 mm and less than or equal to 30 mm, in an implementation mode, it is 20 mm. It can also be set to 17 mm, 18 mm, 22.5 mm, etc., to ensure a sufficient contact area during a buckling process and ensure a buckling effectiveness.

In an implementation mode, the clamping device 100 further includes a connection column 50. The first sealing member 10 and the third sealing member 30 are arranged side by side on the connection column 50. Two ends of the third sealing member 30 are sleeved on the two ends of the connection column 50; the first sealing member 10 that is at an inner side of the third sealing member 30 is sleeved on the connection column 50. The connection column 50 realizes an interconnection of the first sealing member 10, the second sealing member 20, and the third sealing member 30.

In an implementation mode, the second sealing member 20 has a first half ring 210, and the first half ring 210 is provided at the middle of the second sealing member 20; the third sealing member 30 has a second half ring 310. The first half ring 210 and the second half ring 310 are closed to each other at a middle of the connection column 50, and the connection column 50 is provided between the first half ring 210 and the second half ring 310. The first half ring 210 and the second half ring 310 are symmetrical structures, which are stable. A circular ring formed by a closure of the first half ring 210 and the second half ring 310 renders the overall structure more complete, thereby increasing structural strength when the second sealing member 20 is connected to the third sealing member 30.

In an implementation mode, a notch 203 is provided at a middle of the first half ring 210, the notch 203 is configured to separate the second sealing member 20 and the third sealing member 30. Providing the notch 203 facilitates the user to open and close by hands.

In an implementation mode, a surface of the second sealing member 20 facing the first sealing member 10 is provided with an anti-slip area 205, and the anti-slip area 205 is provided with a protrusion to increase a friction with the user, ensuring that it can be held in water immersion and preventing the user from slipping off.

Figure 7:
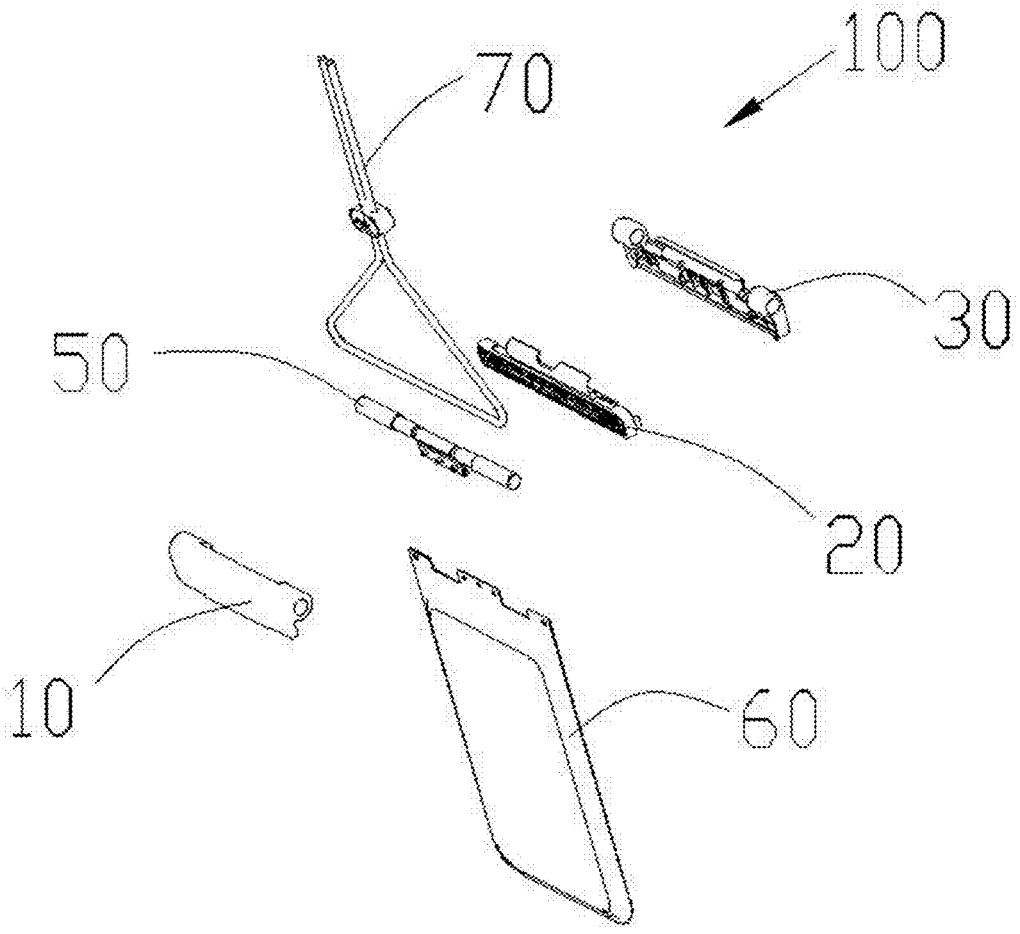
FIG. 7 is an exploded view of the clamping device of the present disclosure.

In an implementation mode, referring to FIG. 7, the clamping device 100 further includes a waterproof bag 60, one side of the waterproof bag 60 with an opening is provided between the second sealing member 20 and the third sealing member 30. The waterproof bag 60 has a cavity configured to store an item, including but not limited to a mobile phone, a camera, a watch, and other items.

In an implementation mode, the clamping device 100 further includes a suspension rope 70 connected to the third sealing member 30. The suspension rope 70 can be directly hung on other objects, such as bags, walls, etc., and the user can also carry it directly, thereby increasing the portability of the clamping device 100.

The above is only preferred embodiments of the present disclosure and does not limit the scope of the present disclosure. Any equivalent structural transformation made under an inventive concept of the present disclosure using the content of this specification and drawings, or directly/indirectly applied in other related technical fields, is included in the protection scope of the present disclosure.

What is claimed is:

1. An opening clamping device for a mobile phone waterproof bag, comprising: a first sealing member, a second sealing member, and a third sealing member, wherein the second sealing member is provided between the first sealing member and the third sealing member;

one side of the first sealing member is capable of being rotatably connected to the third sealing member, and the other side of the first sealing member is capable of being fastened to the second sealing member;

the second sealing member is capable of being connected to the third sealing member; the second sealing member and the third sealing member are configured to clamp a side of the mobile phone waterproof bag with an opening;

when the first sealing member is fastened to the second sealing member, the side of the mobile phone waterproof bag with the opening is clamped and sealed;

wherein the first sealing member is provided with a compression protrusion, and the second sealing member is provided with a compression groove, the compression groove is provided at a middle of the second sealing member, and the compression protrusion is provided on the compression groove.

2. The opening clamping device for a mobile phone waterproof bag according to claim 1, wherein the second sealing member is further provided with a buckle groove and an arc-shaped portion, wherein the arc-shaped portion is provided on one side of the buckle groove and extended towards the third sealing member;

the third sealing member is provided with an installation groove and a curved portion; and the curved portion is provided on one side of the installation groove and bending extended towards the second sealing member;

when the second sealing member and the third sealing member are fastened, the arc-shaped portion is extended into the installation groove, and the curved portion is extended into the buckle groove.

3. The opening clamping device for a mobile phone waterproof bag according to claim 2, wherein there are a plurality of buckle grooves, and the plurality of buckle grooves are symmetrically arranged on the second sealing member.

4. The opening clamping device for a mobile phone waterproof bag according to claim 2, wherein an area of the first sealing member is larger than an area of each of the plurality of buckle grooves, and when the first sealing member is fastened with the second sealing member, the first sealing member covers the buckle grooves.

5. The opening clamping device for a mobile phone waterproof bag according to claim 1, wherein the clamping device further comprises a connection column, wherein the first sealing member and the third sealing member are arranged side by side on the connection column, two ends of the third sealing member are sleeved on two ends of the connection column;

the first sealing member that is at an inner side of the third sealing member is sleeved on the connection column;

the second sealing member has a first half ring, and the first half ring is provided at the middle of the second sealing member;

the third sealing member has a second half ring;

the first half ring and the second half ring are closed to each other at a middle of the connection column;

the connection column is provided between the first half ring and the second half ring.

6. The opening clamping device for a mobile phone waterproof bag according to claim 5, wherein a notch is provided at a middle of the first half ring, and the notch is configured to separate the second sealing member and the third sealing member.

7. The opening clamping device for a mobile phone waterproof bag according to claim 1, wherein four sides of the compression protrusion are protruded in a direction away from the second sealing member, thereby forming a buckle position.

8. The opening clamping device for a mobile phone waterproof bag according to claim 1, wherein a surface of the second sealing member facing the first sealing member is provided with an anti-slip area, and the anti-slip area is provided with a protrusion.

9. The opening clamping device for a mobile phone waterproof bag according to claim 1, wherein the clamping device further comprises a waterproof bag, wherein a side of the waterproof bag with the opening is provided between the second sealing member and the third sealing member;

the waterproof bag has a cavity configured to store an item; and/or, the clamping device further comprises a suspension rope connected to the third sealing member.

* * * * *